United States Patent [19]

Saunders

[11] 3,995,572

[45] Dec. 7, 1976

[54] FORMING SMALL DIAMETER OPENING FOR AEROSOL, SCREW CAP, OR CROWN CAP BY MULTISTAGE NECKING-IN OF DRAWN OR DRAWN AND IRONED CONTAINER BODY

[75] Inventor: William T. Saunders, Weirton, W. Va.

[73] Assignee: National Steel Corporation, Pittsburgh, Pa.

[22] Filed: July 22, 1974

[21] Appl. No.: 490,277

[52] U.S. Cl. ..... 113/120 H; 72/348; 113/116 QA; 113/120 M; 113/120 S; 113/120 D; 113/120 W; 113/120 AA

[51] Int. Cl.[2] ..... B21D 51/12; B21D 51/24

[58] Field of Search ..... 72/348; 113/120 H, 120 M, 113/120 W, 120 S, 120 AA, 120 D, 116 QA; 220/DIG. 22

[56] References Cited

UNITED STATES PATENTS

| | | | |
|---|---|---|---|
| 865,257 | 9/1907 | Kohl | 113/120 H |
| 2,337,182 | 12/1943 | Calleson et al. | 113/120 H |
| 3,196,819 | 7/1965 | Lechner et al. | 113/120 H |
| 3,812,696 | 5/1974 | Knensel et al. | 113/120 AA |
| 3,820,486 | 6/1974 | Hilgenbrink | 113/120 M |

*Primary Examiner*—Carl E. Hall
*Attorney, Agent, or Firm*—Shanley, O'Neil and Baker

[57] ABSTRACT

Method and apparatus for producing a novel one piece, unitary, seamless can body with a reduced diameter opening for receiving an aerosol device or other small diameter closure. A truncated conical configuration portion is formed from sidewall metal in a sequence of operations in which an extended-length reduced-diameter neck is formed with a curvilinear transition zone leading to the main body sidewall portion. A portion of this reduced diameter neck is then further reduced in diameter, and this sequence continued, until the desired size opening is achieved and flanging metal provided for an aerosol device or other small diameter closure. Selection of dimensional parameters and percentage reductions provides for: smooth transition to smaller diameters, maintaining circular configuration, ease of removal of dies permitting operations from one longitudinal end of a can body, and maintaining substantially the original can body height.

5 Claims, 15 Drawing Figures

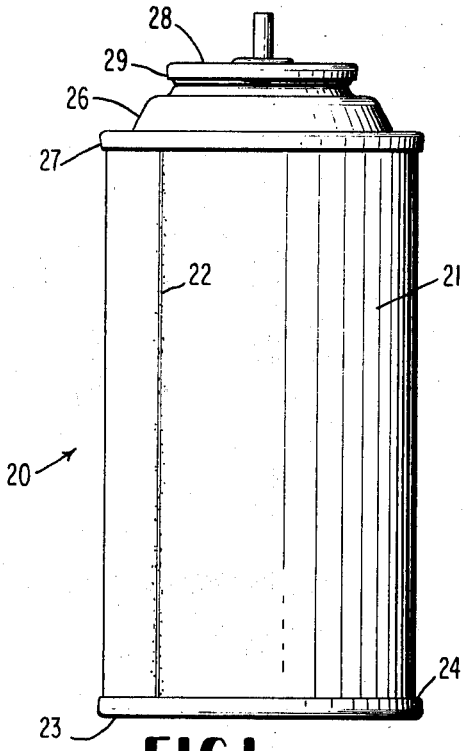
FIG. 1 PRIOR ART
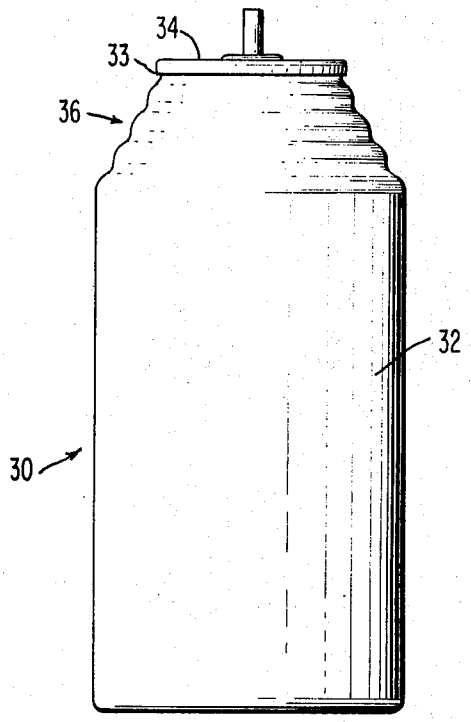
FIG. 2
FIG. 3
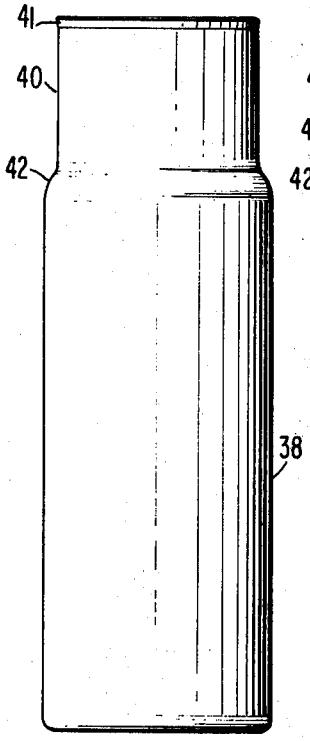
FIG. 4
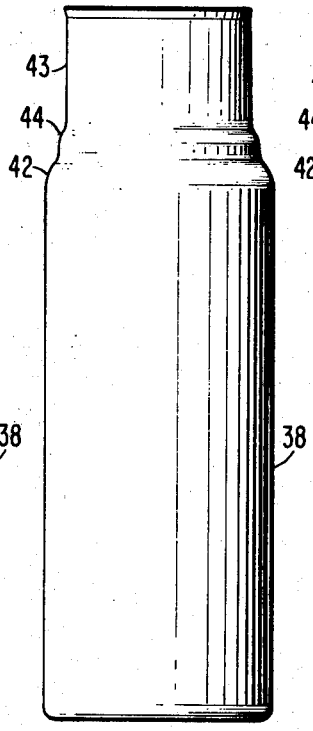
FIG. 5
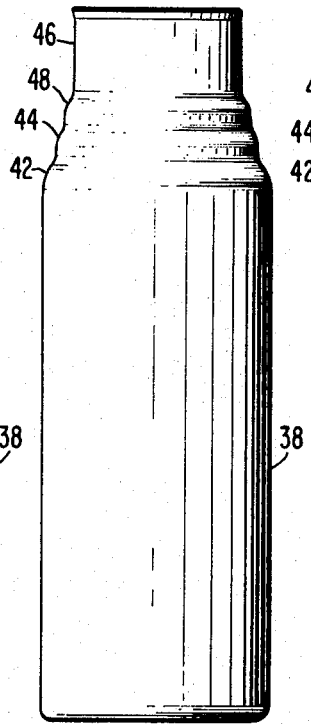
FIG. 6
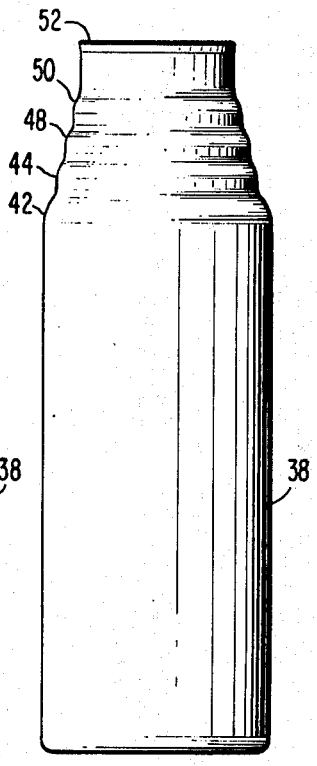

77
76
62
54
64

85
84
79
78
80
82

86
87
80
82

88
89
80
82

BORE DIAMETER
r
R
α
LEAD DIAMETER

FORMING SMALL DIAMETER OPENING FOR AEROSOL, SCREW CAP, OR CROWN CAP BY MULTISTAGE NECKING-IN OF DRAWN OR DRAWN AND IRONED CONTAINER BODY

This invention is concerned with sheet metal can body manufacture. More specifically, this invention is concerned with reducing the diameter of the open end of a one-piece, seam-free, unitary can body to accommodate a reduced diameter closure such as an aerosol device.

The conventional marketed aerosol container is a four-piece assembly. It includes a seamed sidewall, a bottom wall secured to the sidewall by a bottom chime seam, a dome shaped top wall joined to the sidewall by a chime seam, and, an aerosol device closing an opening in the top and joined to the top wall by a seam. The multiple steps required to assemble such a container are expensive. Also the multiple seams of such containers increase the likelihood of leakage from a pressurized container.

Other metal cans having a reduced diameter opening in the top wall present similar problems. For example, a metal beverage can for receiving a pressed-on crown cap or a bottle-size screw cap have also been made from four pieces. The number of pieces can be reduced by a multi-step forming and cutting process (e.g. the process disclosed in the Calleson et al. U.S. Pat. No. 2,384,810). All such prior art processes require multiple pieces, in excess of two, and multiple seams to finish a can.

The present invention eliminates such multiple part can bodies, multiple seams, and multiple step assembly methods by making possible manufacture of a novel one-piece seam-free unitary can body with a reduced diameter opening at one end for receipt of a closure. Advantageous contributions which result are economy of manufacture and a safer and more attractive product.

Figure 9:
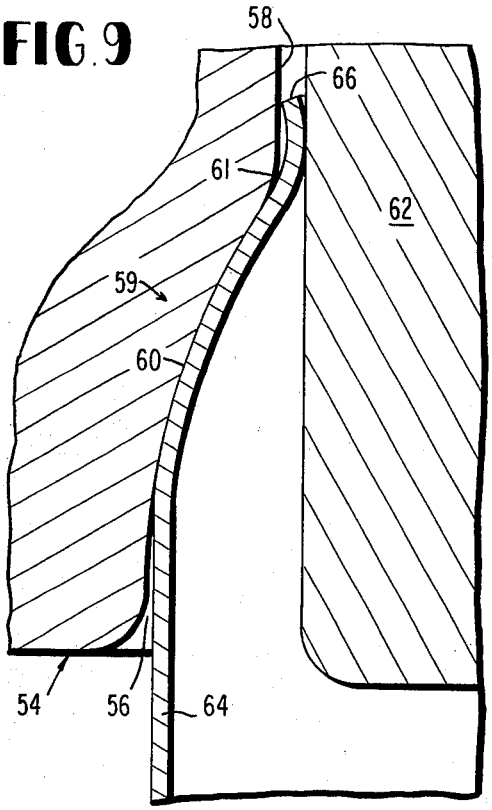
Figure 10:
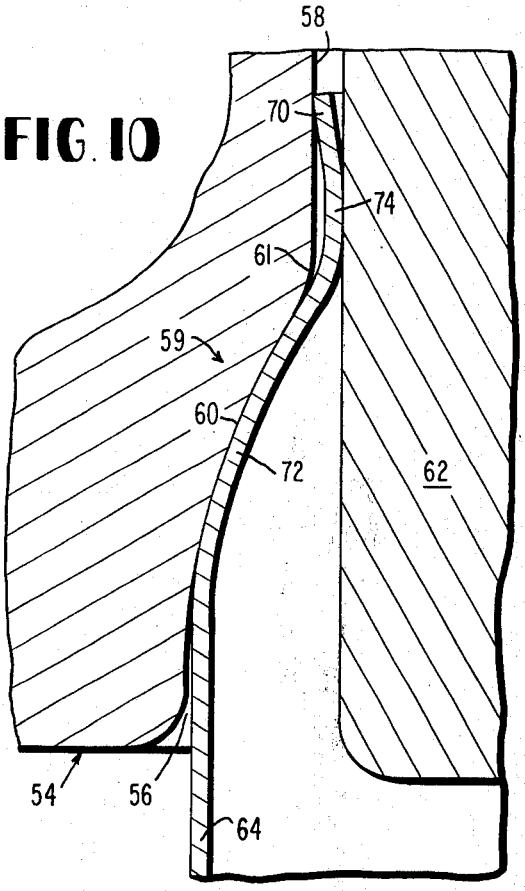
Figures 11, 12, 13, 14, 15:
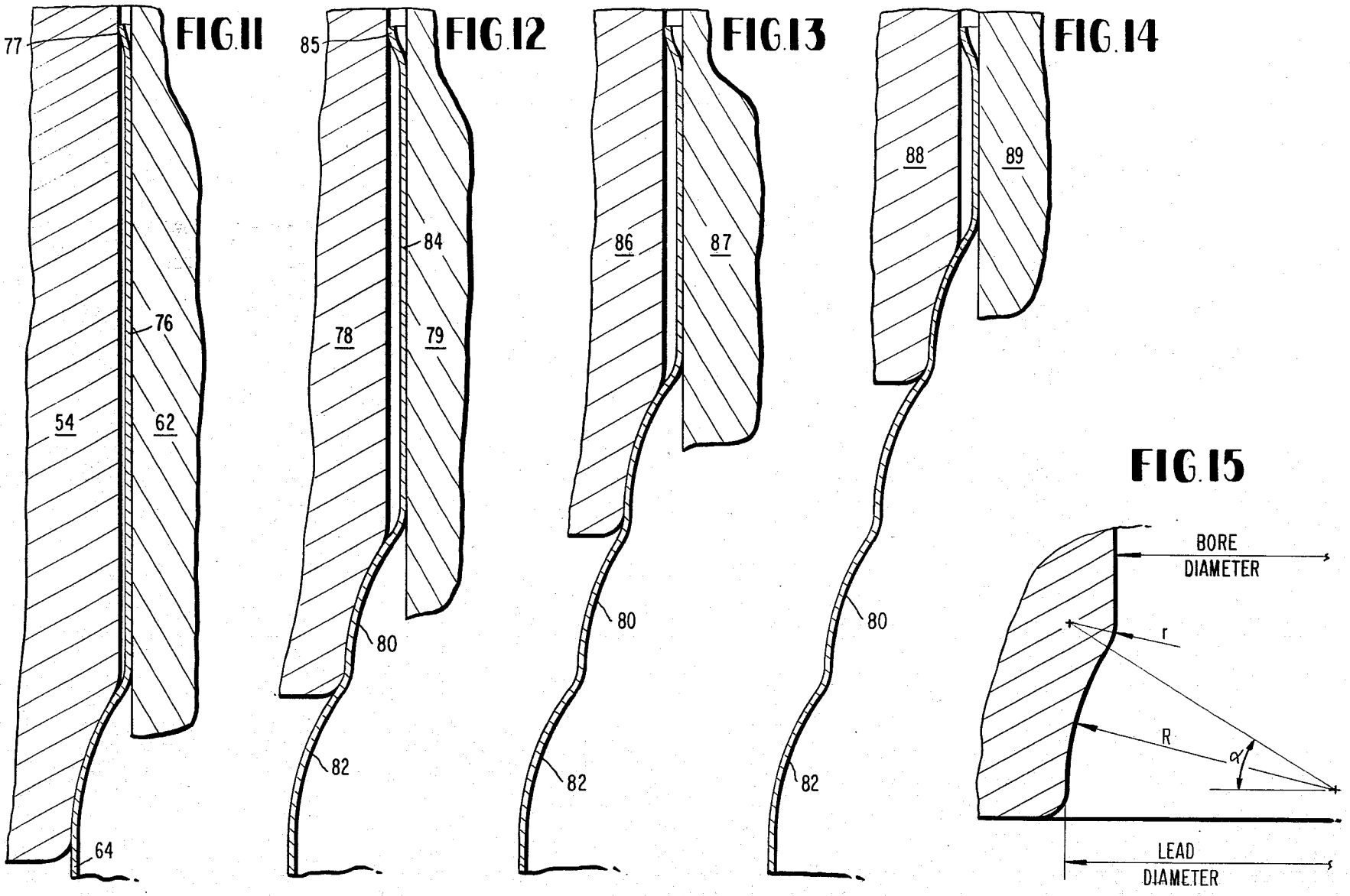

The accompanying drawings used for presenting a more detailed description of the invention include the following figures:

FIG. 1 is a view in elevation of a four-piece metal can of the prior art,

FIG. 2 is a view in elevation of the novel metal can of the present invention, FIG. 3 is a view in elevation of the novel sheet metal can body of the present invention having a reduced diameter at its open end, FIGS. 4 through 6 are views in elevation of the metal can body of FIG. 3 in subsequent stages of producing the reduced diameter open end, FIGS. 7 through 10 are enlarged cross section cutaway views for illustrating stages in a reduction in diameter operation of the present invention, FIGS. 11 through 14 are enlarged cross section cutaway views showing the sequence of operations in producing the reduced diameter opening of the type shown in the embodiment of FIG. 6, and FIG. 15 schematically illustrates a portion of a die with identifying nomenclature for presentation of data from a specific embodiment of the invention.

FIG. 1 represents a typical prior art, four-piece aerosol can 20. Sidewall 21 is formed from flat rolled sheet metal by means of side seam 22. A bottom wall 23 is joined to sidewall 21 by bottom chime seam 24. A top end wall 26 is joined to the sidewall by top chime seam 27. A closure 28, such as an aerosol device is inserted in the opening in top wall 26 and joined to the top wall by seam 29. Similar structures have been used for other cans, such as carbonated beverage cans, in which the top wall closure 28 takes various forms such as a crown cap or screw cap.

In contrast to the four-piece assembly of FIG. 1, a can assembled using the teachings of the present invention is shown at 30 in FIG. 2. Can 30 includes a one-piece, seam-free, unitary sheet metal can body 32 and a closure 34 for the reduced diameter opening at the top end.

Can body 32 of FIG. 2 is formed from a drawn cup or drawn and ironed cup. The cup is seamless and usually of cylindrical configuration with a substantially uniform diameter sidewall and a unitary bottom wall at one longitudinal end of the sidewall. The novel steps of the present invention result in a stepped configuration portion 36, of truncated conical configuration in longitudinal cross section, leading from the full diameter portion 32 of the initial cup to the reduced diameter opening 33 closed by closure 34.

Part of the invention is a unique reduction in diameter method in which sequential steps produce the particular size opening required. Typical can body diameters would range from about an inch and a half in diameter for small aerosol cans up to about a five inch diameter such as used in a large fruit juice can. With the invention, the sidewall at the closure end can be reduced in any amount, e.g. from 10% to reductions in diameter in excess of 50%. Conventional necking-in reductions would generally be less than 5%. The large reductions of the present invention are provided while maintaining roundness without fluting or wrinkling of the metal.

Referring to FIGS. 3 through 6, the configuration of the can body is shown during a four-stage reduction in diameter procedure in accordance with the present invention. The number of reduction in diameter stages can be changed dependent on the container application. In FIG. 3, sidewall 38 has been reduced in diameter at its open end and a longitudinally extended neck portion 40 formed. A curvilinear configuration transition juncture 42 is formed between reduced diameter neck 40 and the main sidewall portion 38. Note at the top edge that the metal forms a rib by taking an inflection from the cylindrical configuration of the remainder; this turn of the metal, designated rib 41, occurs at the peripheral edge of the opening and contributes a strengthening effect enabling a larger reduction in diameter than would ordinarily be possible in a single step. The existence of strengthening rib 41 is felt to facilitate the formation of a wrinkle-free neck 40 of extended longitudinal length, as desired, while permitting a relatively large transition juncture 42. The clearances provided, as discussed later, permit the formation of rib 41 which in general has a longitudinal height several times the thickness gage of the metal.

FIG. 4 shows the results of a second reduction in diameter operation in which the reduced diameter portion 40 of FIG. 1 is further worked. This second reduction in diameter occurs at a second transition juncture 44. In the process, the overall height of the can body being worked does not change appreciably because the excess metal generated in reducing the circumference of the can body is taken up in forming the curvilinear configuration transition junctures; i.e., the excess metal generated is taken up to a large extent in the horizontal (transverse to the longitudinal axis) component of such junctures.

FIG. 5 shows the configuration resulting after a further reduction in diameter applied to the reduced diameter portion of 43 of FIG. 4; the further reduction for reduced diameter portion 46 being produced at a third curvilinear configuration transition juncture 48.

FIG. 6 shows the results when a fourth reduction in diameter operation is performed on portion 46 of FIG. 5 with curvilinear configuration transition juncture 50 leading to a reduced diameter opening 52. The metal in the generally cylindrically-shaped axially oriented portion 52 at the open end of the can body is used as flanging metal for forming a seam for an aerosol device or shaped for receiving a cap.

The multiple sequential reduction in diameter operations are carried out on a sheet metal can body sidewall such as the sidewall of a drawn cup or drawn and ironed cup. Typically the can body is formed from flat rolled steel by conventional methods. The obstacles to working drawn and ironed cans were known and accepted by those skilled in the art. A drawn and ironed steel cup which is produced from a steel blank having a gage of approximately 0.010 inch to 0.020 inch will have a sidewall gage near its top end of roughly 0.005 inch to 0.010 inch. This sheet metal will be in the substantially full hard condition. Presumably because of this full-hard condition, the configuration shown had not been contemplated in the unitary can body prior art. The metal-movement control teachings of the invention form one of its major contributions in making this configuration possible working from the single open end of a unitary can body. It is believed that the compressing of the metal occuring in the curvilinear transition zones of the dies facilitates the working of the full hard steel.

FIGS. 7 through 10 illustrate the novel reduction-in-diameter stages. The dies shown in part are symmetrical about a center line. These expanded views in cross section show one side only of a cutaway portion of the die structure working on a portion of the open end of the sheet metal can body. The "compressing" of the metal can be visualized when it is understood that the actions depicted by FIGS. 7–10 occur about the full periphery of the sidewall.

Figure 7:
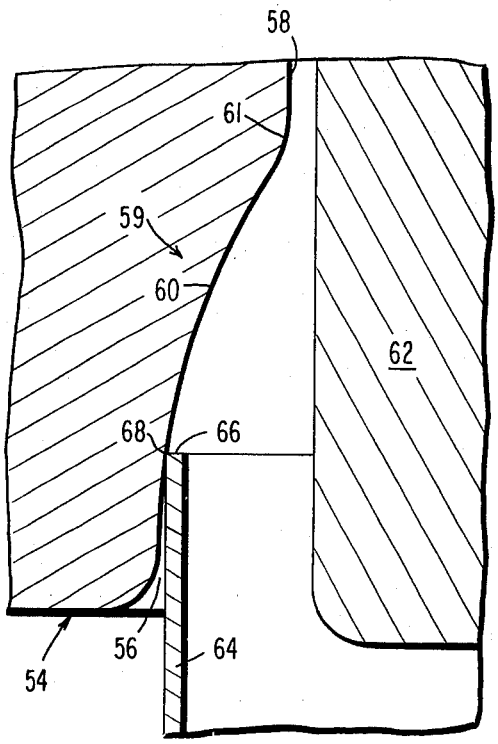

Outer die 54 of FIG. 7 has an entry portion 56 of larger diameter than the outer diameter of the original sheet metal cup. Longitudinally opposite to the entry end, outer die 54 has a reduced diameter cylindrical portion 58. Reduced diameter cylindrical portion 58 has an inner diameter approximately equal to the reduced diameter to be achieved by the stroke, for example the diameter of cylindrical portion 40 of FIG. 3. Entry portion 56 and the smaller diameter cylindrical portion 58 of the outer die 54 are joined by a curvilinear configuration transition zone 59. This zone defines a relatively large radius section 60 leading toward a smaller radius section 61.

Inner die 62 is substantially cylindrical in configuration; it is a pilot or guide type die and need not exert the continual force of the usual working die in accordance with the present invention. Inner die 62 has a diameter to allow sufficient clearance for the thickness of the sheet metal 64, to allow for movement of metal including strengthening rib 44, and to allow for retraction of the pilot die along its original approach path. This spacing between vertical portions of the dies would generally be several times the thickness of the metal, and can be as much as five times such thickness. Clearance is determined based on a number of factors — the reduction in diameter to produce a rib such as 44, selection for maximum reduction, and the size of the pilot die required to maintain roundness; the latter meaning a circumferentially smooth configuration, i.e. circular, rather than a "fluted" configuration with multiple straight line chords approaching a circular configuration.

Since the sequential reduction in diameter of the present invention is performed from only one end of the sheet metal can body, the inner die must be removed from that end after each reduction in diameter. In effect, because of the required clearance, the outer die can be designated as a "working" die in the usual sense of exerting a working force throughout the die-forming process from initial contact of the open end peripheral edge to the end of the stroke. Each reduction in diameter operation is carried out in a single stroke.

Figure 8:
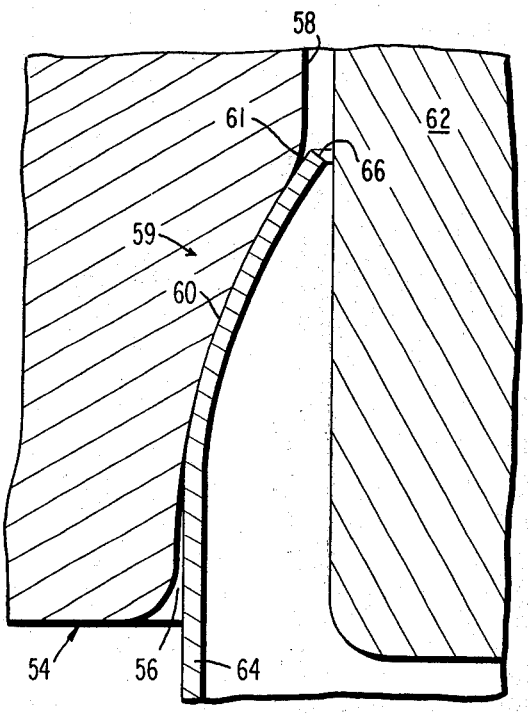

In order to accomplish the objectives of the invention the reduction in diameter operations should provide a longitudinally extended neck of reduced diameter without wrinkling of the metal or "fluting". The configuration of the outer die 54 and the size and dispositional relationship between the outer die transition zone 59, pilot die 62, and the sheet metal can body 64 enter into achievement of these results. In the novel method, the peripheral edge 66 of the sidewall 64 is caused to make contact within the curvilinear configuration transition zone 59 and follow that contour inwardly. For this purpose contact should occur at a location 68 within the transition zone 59 to provide a smooth, oval-shaped turn-in of metal. FIG. 8 shows the results of such contact; the peripheral edge 66 is turned smoothly inwardly toward the inner pilot die 62. Shortly thereafter, as shown in FIG. 9, contact with the pilot die 62 turns the peripheral edge 66 longitudinally toward the open end and outwardly toward the outer die 54. This slight inflection in the peripheral edge metal forms strengthening rim 70. This strengthening rim, generally having a longitudinal height equal to about two and a half to five times the thickness gage of the metal, reinforces the sheet metal at the open end to permit the reduction in diameter caused by die portion 60 (FIG. 10) to proceed in a controlled and uniform manner over a longitudinally extended portion without wrinkling or "fluting" of the metal.

The strengthening rim helps to maintain the circular configuration of the metal at the open end throughout the operation. As shown in FIG. 10, there is a tendency, because of strengthening rim 70, for the peripheral edge metal to be centered between the surface of cylindrical configuration portion 58 of the outer die 54 and center die 62 as the relative movement of the sidewall metal is upwardly in the space between the outer die 54 and inner die 62 while the curvilinear configuration transition zone 60 works on the metal in the sidewall 64 to reduce its diameter from the original diameter to that existing between the inner and outer die. This reduction in diameter can be extended longitudinally as desired, e.g. an inch or more, without wrinkling the metal. The working stroke (downward relative movement) of the outer die 54 is continued to produce a neck of desired length such as the reduced diameter portion 40 shown in FIG. 3. After forming the desired "neck", the dies are retracted along the approach path. The die forming step has formed a curvilinear configuration juncture at the original diameter, a longitudinally extended cylinder, and a strengthening rim.

To produce the configuration of FIG. 6, multiple reduction in diameter operations are performed sequentially. Each succeeding operation is performed on the reduced diameter portion of the next preceding operation. The same type operation, with selection of dimensional relationships as required, is repeated to ultimately produce the generally truncated conical configuration with stepped intervals as shown in FIG. 6. In each operation an edge strengthening means, such as the strengthening rib 70 of FIG. 9 exists at the top peripheral edge and facilitates the operation by eliminating the wrinkling of metal as the diameter is reduced. The generated metal from the reductions in diameter is absorbed largely in the curvilinear configuration junctures in the sheet metal can body sidewall between the varying diameter portions but, the sidewall metal thickness gage also increases slightly.

FIGS. 11 and 14 are expanded schematic cutaway views showing the sequence of steps in cross section on one portion of a sidewall for forming the truncated-cone, stepped configuration at the open end of a sheet metal can body of the type shown in FIG. 6. In FIG. 11 outer die 54 has been plunged to form the extended necked-in portion 76 in the sidewall 64 of the can body with rib 77 at its upper end.

In the second operation, as shown in FIG. 12, an outer die 78 and inner die 79, sized to perform on the longitudinally extended reduced diameter neck portion 76 of FIG. 11, form a second curvilinear configuration juncture 80 in the metal sidewall above the first curvilinear configuration juncture 82 and produce the longitudinally extended reduced diameter neck portion 84. The strengthening rim 85 at the upper end of the can body enables the metal to move smoothly within the clearance provided and facilitates removal of the pilot die at the end of each stroke.

FIGS. 13 and 14 show subsequent third and fourth reductions in diameter operations with additional dies 86 and 87 sized to the necked-in cylindrical portion of FIG. 12 and dies 88 and 89 sized to the necked-in cylindrical portion of FIG. 13.

FIG. 15 provides the reference points for the data presented in Table I. The portion of an outer die shown in FIG. 15 corresponds substantially to that shown in FIG. 7. E.g. "R" corresponds to the curvilinear transition zone radius 60, "*r*" to the smaller radius section 61, the "Lead Diameter" to the smaller diameter at the entry portion 56, and the "Bore Diameter" to the diameter of the reduced diameter cylindrical portion 58; the orientation of angle is shown in FIG. 15.

The data shown in Table I covers full operation working on a unitary steel can body for a "108 can" (nominal 1-8/16" diameter) in which the open end of the can body is reduced from about one and one-half inches in diameter to about one inch. Also formuli for arriving at selected values are set forth.

Referring to the tabulated data: in the second column of Table I, the total change in diameter at the end of each operation is set forth in thousandths of inches; e.g. "0.122Δ" means the diameter was reduced by 0.122 inch in the first operation; "0.235Δ" means that the diameter was reduced a total of 0.235 inch by the combined first and second operations, etc.

TABLE I

| Operation & Mark | Lead Dia. | R* | r | Bore(+) Dia. | % Reduction | Plug Clear. (Diam.) | Metal Thk. | ∠α |
|---|---|---|---|---|---|---|---|---|
| 1 .122Δ | 1.504 | .375 | .060 | 1.370 | 8.9 | .033 | .0105 | 32.2° |
| 2 .235Δ | 1.370 | .353 | .060 | 1.250 | 8.6 | .045 | .0115 | 31.3° |
| 3 .342Δ | 1.250 | .332 | .060 | 1.143 | 8.4 | .050 | .0123 | 30.3° |
| 4 .433Δ | 1.143 | .312 | .060 | 1.052 | 8.1 | .051 | .014 | 28.6° |

*.94 $(R_n) = R_{n+1}$
(+)$\%_1 = 91/1$
$\%_1$(Can OD + .002) = 1st Bore
= 1.003
$(\%_{n-1}) = \%_n$
$_n(\text{Bore}_{n-1}) = \text{Bore}_n$ It should be recognized that the percentage reduction with each sequential operation is decreasing slightly with each step. The value of "R" in the second operation is 94% of its value in the first operation; the value of "R" in the third operation is 94% of its value in the second operation, etc.; thus the formula $(0.94(R_n) = R_{N+1})$, where "*n*" is the previous operation. From this and empirical operations the factor "*f*" is obtained; "*f*" has a value slightly greater than one. This provides a slight decrease in the percentage reduction with each sequential operation. Subtracting the reduction from 100% provides the "balance remainder", e.g. 100% − 8.9% = 91.1%. The first "Bore Diameter" and each reduction in diameter are derived accordingly. Note that the "Bore Diameter" of operation No. 1 is the same as the "Lead Diameter" of operation No. 2, etc.

Such sequential operations are performed without substantial change in the overall height of the sheet metal can body notwithstanding the reduction in diameter which generates metal. However, the generated metal is taken up in the curvilinear configuration transition junctures being formed, that is in the horizontal components of the juncture. Also, it should be noted that there is a slight increase in the thickness of the sidewall metal being worked on with each operation.

In each operation, the diameter of the inner pilot-type die is selected to allow maximum clearance for ease of removal while still maintaining roundness in the reduced diameter portion. Ease of withdrawal is necessary because the operation takes place at one end of a can body sidewall without access from the remaining end.

Typical gages of the sheet metal when working a drawn aluminum cup would be about 0.015 inch to about 0.025 inch; when working with a drawn and ironed aluminum cup the sidewall gage would be between about 0.0075 inch and about 0.0125 inch.

The specific examples with tabulated data are for the purpose of enabling those skilled in the art to readily practice the invention. With the above description this invention can be applied to can bodies of many types and modifications in materials, steps, specific dimensions, and design details can be made without departing from the basic teachings of the present invention. For example, the number of reduction in diameter steps performed to achieve the small diameter opening taught by the invention can be selected. It is to be understood however, that the scope of the invention is to be determined from the appended claims.

What is claimed is:

1. Method for reducing the diameter of the sidewall at the open end of a single-piece sheet metal can body comprising providing a seam-free unitary can body having a sidewall disposed about a longitudinal axis and a unitary endwall at one longitudinal end of the sidewall, the unitary can body sidewall having a peripheral edge defining an open end at the remaining longitudinal end of the sidewall opposite to the unitary endwall, reducing the diameter of the sidewall contiguous to the open end of the unitary can body by a plurality of die forming operations in excess of two to form a truncated cone configuration portion at the open end of the can body, the truncated cone configuration portion having a stepped configuration in longitudinal cross section with the total reduction in diameter at the open end of the can body being at least one-third of the original diameter of the sidewall portion at the open end, the stepped configuration comprising a plurality of reduced diameter gradations starting with a reduction in diameter portion which is of curvilinear configuration in longitudinal cross section and located to form a juncture with the original diameter portion of the sidewall and progressing with further reduction in diameter portions toward the open end of the can body, the plurality of die forming operations forming such stepped configuration being carried out in sequence, the initial die forming step forming the curvilinear configuration reduction in diameter juncture at the original diameter portion of the sidewall, a longitudinally extended cylinder of substantially-uniform reduced diameter corresponding to the reduction in diameter at the curvilinear configuration juncture, and, an inflection in the sheet metal of the reduced diameter cylinder out of its cylindrical configuration at the open end periphery, such inflection of the sheet metal forming a strengthening rim in such open end peripheral metal, and each next sequential die forming step being carried out on such reduced diameter cylinder of the next preceding die forming step utilizing die means of reduced diameter characteristics in relation to die means of the next preceding die forming step, with each separate die means utilizing a loosefitting inner pilot-type die means for maintaining such cylindrical configuration without otherwise supporting the can body internally by maintaining clearance for ease of removal of such pilot-type die means after each reduction in diameter, the initial die forming step reducing the diameter a selected percentage of the original diameter with each subsequent percentage reduction in diameter being less than the next preceding previous percentage reduction in diameter.

2. The method of claim 1 in which the die forming steps are carried out while maintaining the longitudinal dimension of the uniform can body substantially the same and in which the die forming steps increase the thickness gage of the sidewall sheet metal being formed.

3. The method of claim 1 in which the seam-free unitary can body provided comprises flat rolled steel drawn to form a cup and having its sidewall ironed to elongate such sidewall and reduce its thickness gage such that the step of reducing the original diameter of the sidewall at the open end of the unitary can body is carried out on substantially full-hard steel.

4. The method of claim 3 in which the thickness gage of the drawn and ironed steel sidewall contiguous to such open end of the unitary can body is in the range of about 5 mils to about 10 mils.

5. The method of claim 1 in which each die forming operation is carried out with die structure comprising an outer die and an inner pilot die, such inner die being of substantially cylindrical configuration and having a diameter providing clearance for removal of the inner die after a reduction in diameter operation, the outer die having an entry portion of larger diameter than the outer diameter of the sheet metal can body sidewall at such open end for initial reception of the can body sidewall and, spaced longitudinally therefrom, a smaller diameter portion approximately equal to the outer diameter of the desired reduced diameter cylindrical portion, the larger diameter portion and smaller diameter portions of the outer die being joined by a curvilinear configuration transition zone, applying the die to the sheet metal can body sidewall by relative movement between the dies and the sidewall such that initial contact of the peripheral edge of the can body sidewall occurs within the transition zone and the transition zone turns such peripheral edge inwardly along such curvilinear configuration transition zone toward the inner die, then such peripheral edge, upon contact with the inner die being turned outwardly and then in the direction of the open end to form the strengthening rim at such peripheral edge, such strengthening rim having a longitudinal length approximately two and one-half to five times the thickness gage of the sidewall metal contiguous to such peripheral edge, and then continuing longitudinal relative movement between the dies and the can body sidewall to form the reduced diameter substantially cylindrical portion of desired longitudinal length.

* * * * *

UNITED STATES PATENT OFFICE

CERTIFICATE OF CORRECTION

Patent No. 3,995,572 Dated December 7, 1976

Inventor(s) William T. Saunders

It is certified that error appears in the above-identified patent and that said Letters Patent are hereby corrected as shown below:

Columns 5 and 6, lines 12-25, in the footnote of TABLE I:

line 1, "* $.94(R_n) = R_{n+1}$" should read --* $.94(R_n) = R_{N+1}$--;
line 4, "= 1.003" should read -- $\mathcal{F}$ = 1.003--;
line 5, "$(\%_{n-1}) = \%_n$" should read -- $\mathcal{F}$ $(\%_{n-1}) = \%_n$--;
line 6, "n $(Bore_{n-1}) = Bore_n$" should read --$\%_n$ $(Bore_{n-1}) = Bore_n$--.

Column 5, line 34, "and" should read --through--.

Column 7, lines 40-51 should be indented under the paragraph appearing at lines 37-39.

Signed and Sealed this

Fifteenth Day of February 1977

[SEAL]

*Attest:*

RUTH C. MASON
*Attesting Officer*

C. MARSHALL DANN
*Commissioner of Patents and Trademarks*